US009820552B2

(12) United States Patent
Frymire

(10) Patent No.: US 9,820,552 B2
(45) Date of Patent: Nov. 21, 2017

(54) ALL IN ONE BEAUTY PEN—BEAUTY BULLET

(71) Applicant: Kimberly Ann Frymire, Jobstown, NJ (US)

(72) Inventor: Kimberly Ann Frymire, Jobstown, NJ (US)

( * ) Notice: Subject to any disclaimer, the term of this patent is extended or adjusted under 35 U.S.C. 154(b) by 132 days.

(21) Appl. No.: 14/799,574

(22) Filed: Jul. 15, 2015

(65) Prior Publication Data

US 2017/0013941 A1 Jan. 19, 2017

(51) Int. Cl.

| | |
|---|---|
| ***A45D 40/24*** | (2006.01) |
| ***A45D 40/26*** | (2006.01) |
| ***A45D 40/02*** | (2006.01) |
| ***A45D 40/18*** | (2006.01) |
| ***A45D 40/20*** | (2006.01) |

(52) U.S. Cl.

CPC ..... *A45D 40/261* (2013.01); *A45D 40/02* (2013.01); *A45D 40/18* (2013.01); *A45D 40/20* (2013.01); *A45D 40/24* (2013.01); *A45D 2200/25* (2013.01)

(58) Field of Classification Search

CPC ..... A45D 40/24
USPC ..... 401/18, 51; 132/294
See application file for complete search history.

(56) References Cited

U.S. PATENT DOCUMENTS

| | | | | |
|---|---|---|---|---|
| 3,320,962 | A * | 5/1967 | Moriber | 401/31 |
| 5,109,877 | A * | 5/1992 | Takeda | A46B 7/023 132/218 |
| 5,715,848 | A * | 2/1998 | Conley, Jr. | A45C 11/008 132/297 |
| 8,156,949 | B2 * | 4/2012 | Albert | A45D 33/26 132/297 |
| 2007/0031176 | A1 * | 2/2007 | Gieux | A45D 40/20 401/50 |
| 2014/0341631 | A1 * | 11/2014 | Cakridas | A45D 40/24 401/18 |

* cited by examiner

*Primary Examiner* — David Walczak
*Assistant Examiner* — Joshua Wiljanen

(57) ABSTRACT

The All in one Beauty Pen—Beauty Bullet embodiment is all of the items you would need for a full face of makeup for day or night conveniently compacted and stationary in 2 pen embodiments that attach as one, eliminating lost items and clutter.

19 Claims, 3 Drawing Sheets

ALL IN ONE BEAUTY PEN—BEAUTY BULLET

BACKGROUND

The all-in-one cosmetic device contains all of the items you would need for a full face of makeup for day or night conveniently compacted and stationary in two parts that attach together as one, eliminating lost items and clutter.

BRIEF SUMMARY OF THE INVENTION

It takes several items of make up to put on a complete beautiful face. These items often get lost in your purse, backpack, suitcase and drawers. You also might forget one or a couple of the items when packing your purse for the day or when packing your suitcase when traveling for business, vacation, or overnight. Currently one must put all items of make up individually in a bag or purse, while hoping not to forget anything, often leaving you with eye shadow without mascara, eye liner without lip gloss, etc, Not to mention the messy clutter it creates in your bags, drawers, or counter space. Then one must fish through the bag or purse to find the items of make up when needed. It is difficult to find those items at the bottom of the bag.

There is nothing currently available that puts all of your beauty items in one "stationary" carrying embodiment eliminating clutter and preventing lost items. The All in one Beauty Pen—Beauty Bullet puts all of those items in one convenient carrying embodiment, for ease of location in bags, never forgetting an item needed in your daily beauty routine, quick grab and go, and clutter free.

DETAILED DESCRIPTION AND BEST MODE OF IMPLEMENTATION

Figure 1B:
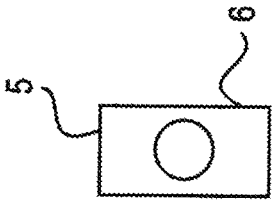
FIG. 1B shows a front view of a cap for the first part of the cosmetic device.
Figure 1D:
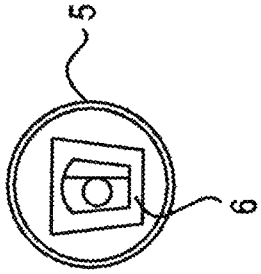
FIG. 1D shows a rear view of a cap for the first part of the cosmetic device.
Figure 1A:
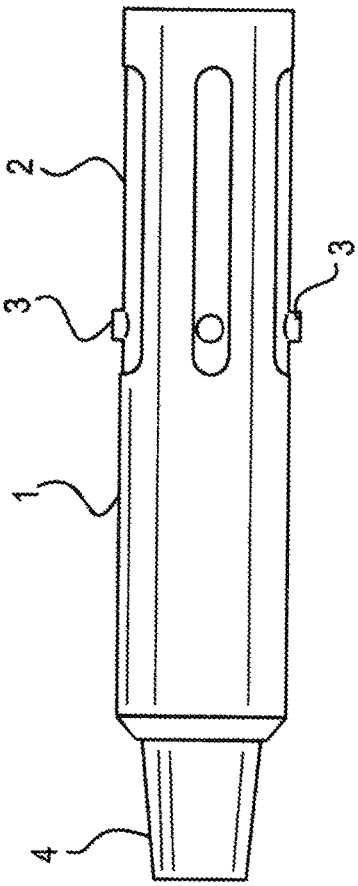
FIG. 1A shows a side view of a first part of a cosmetic device.
Figure 1C:
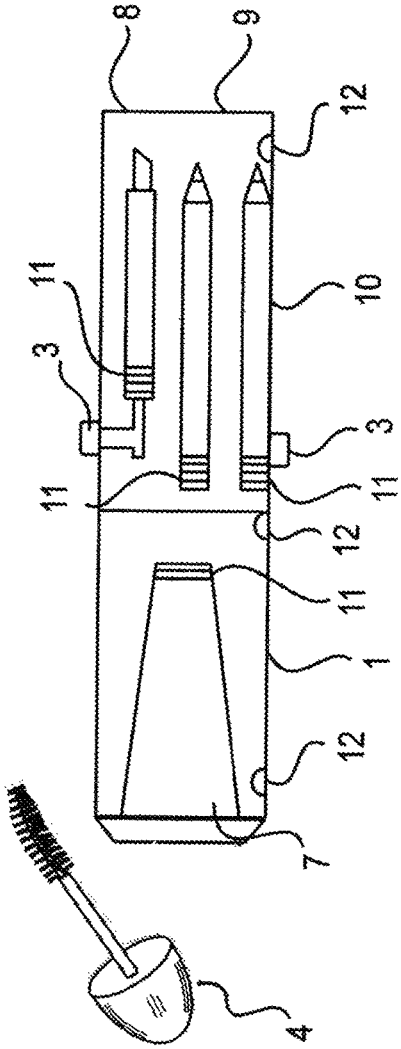
FIG. 1C shows a sectional view of the first part of the cosmetic device.
Figure 2A:
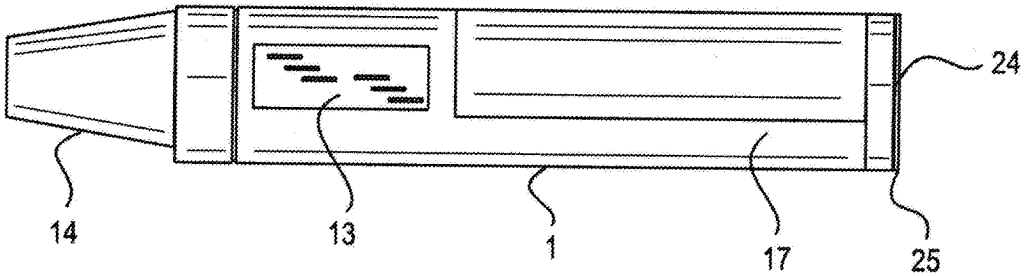
FIG. 2A shows a side view of a second part of the cosmetic device.
Figure 2B:
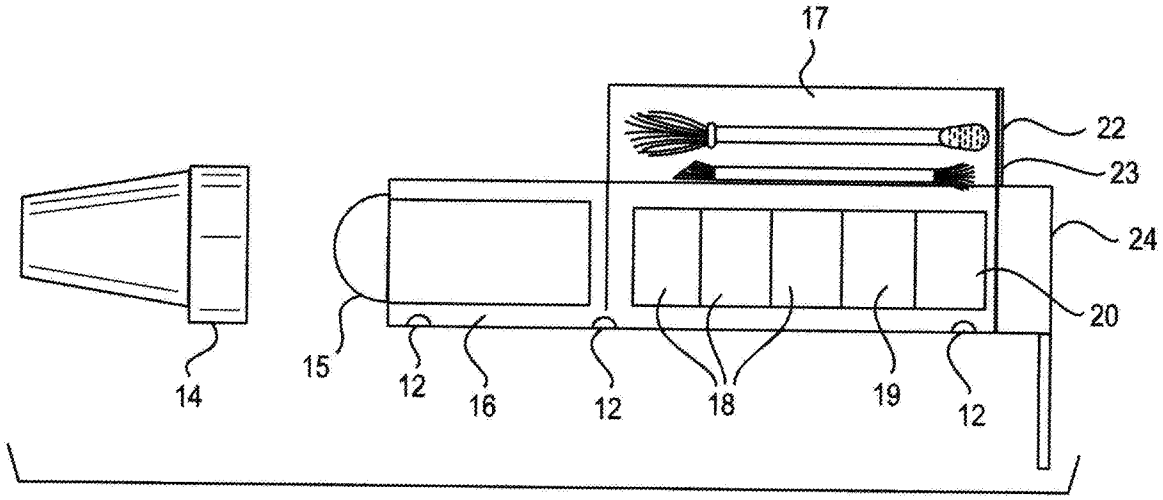
FIG. 2B shows a sectional view of the second part of the cosmetic device, including a cap for the second part of the cosmetic device.
Figure 2C:
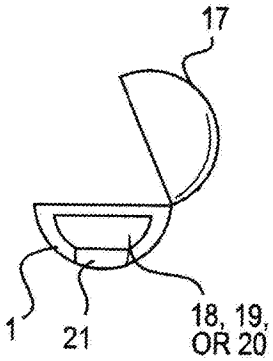
FIG. 2C shows a rear view of the second part of the cosmetic device.

FIGS. 1A-D show the first part of a cosmetic device—the "finishing" portion of the cosmetic device—used to encompass all of the products needed to complete a full face of make up. The first part of the cosmetic device comprises a housing (1). On one end is a plurality of cosmetics, preferably an eye brow pencil (9), an eye liner pencil (10), and "Push Pop Lip Gloss/Lip Stick" (8). Each of these three cosmetics (8, 9, 10) comprises threads (11), which attach to a push button base (3) having opposite threads so that the cosmetics (8, 9, 10) may be attached to the push button base (3). The first part of the cosmetic device also comprises a separate track (2) for each of the plurality of cosmetics (8, 9, 10), so that the cosmetics (8, 9, 10) attached to the push button base (3) may be extended and retracted individually for use. The threads (11) also allow for easy changing and refilling of pencils while keeping them attached and stationary at all times. The first part of the cosmetic device further comprises a cap (5) with a sharpener inside (6), which closes the end keeping pencils and Push Pop Lip Gloss/Lip Stick clean. At the other end is a cosmetic reservoir (7) which is also threaded (11) for ease of changing and refilling while keeping stationary and attached at all times. The other end is also provided with a cap (4) to attach to the housing (1) and cover the reservoir (7). The cap (4) is provided with a mascara wand to enable a user to apply mascara that is contained in the reservoir (7). The housing (1) further comprises magnets (12) to allow the first part of the cosmetic device to attach to a second part of the cosmetic device.

FIGS. 2A-D shows the second part of the cosmetic device—the "color" portion of the cosmetic device. The second part of the cosmetic device comprises a second housing (1). The second housing (1) has a mirror (13) on an exterior wall of the housing (1). On one end of the housing (1) is a compartment (16). The end of the compartment (16) on one end of the housing (1) is capped by a "roll on" top (15) attached to the housing (1) or compartment (16) by threads, so that the "roll on" top (15) may be taken off and on to allow access to the compartment (16) to fill and refill foundation. The housing further comprises a flip door (17) hingedly attached to the housing (1), wherein the exterior portion of the door (17) makes up part of the exterior wall of the housing (1) when in the closed position. When in the open position, a compartment is exposed, wherein the compartment houses cosmetics (18, 19, 20), preferrably three individual eye shadow colors, blush, and concealer. The compartment further houses a plurality of double sided brushes, preferably blush/concealer (22) and eye shadow/angle (23), for applying the cosmetics (18, 19, 20). All of the make up color pallets (18, 19, 20) are concave in shape to hold more product and have a magnetic bottom (21) for ease of changing pallet colors while keeping them in place. The other end of the second housing (1) has another compartment (24) that houses another cosmetic, preferrably lip gloss, which is closed by a swivel door (25). The second housing (1) further comprises magnets (12) to allow the second part of the cosmetic device to attach to the first part of the cosmetic device.

Figure 3:
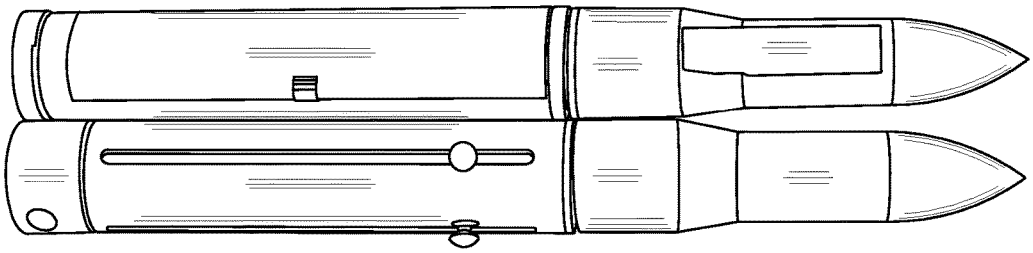
FIG. 3 shows a side view of the first part and second part of the cosmetic device attached together.

FIG. 3 shows the first and second part of the cosmetic device—the "color" and "finishing" portions—connected together in a side-by-side configuration by the magnets.

The cosmetic device is all of the items you would need for a full face of make up for the day or night conveniently compacted and stored in two housings resembling "pens" that attach as one, eliminating lost items and clutter.

On the second part of the cosmetic device, color pallets are individually purchased, the flip door is opened and the three eye shadow pallets, blush pallet, and concealer pallet are exposed. The eye shadows, blush, and concealer pallets are all "individual" with magnets on the bottom for ease of re-filling and or changing colors, while holding them intact and stationary. The colors for day or night are chosen and inserted. Two double sided brushes are conveniently stored on the flip door with snap in inserts. The flip door is closed. The other end is the foundation end. The cap is removed, exposing the "roll on" top. The roll on top is threaded, and when opened exposes compartment to fill and re-fill foundation. The foundation is poured into the compartment. The "roll on" top is screwed back on, and the cap is replaced. The second part of the cosmetic device—the "color" part is ready.

On the first part of the cosmetic device, the cosmetics, preferrably a brow pencil, eye liner pencil, "Push Pop Lip gloss/Lip stick" and mascara are individually purchased. They have threaded bottoms for ease of removal, filling and re-filling while holding them in tact and stationary. The cap is removed from the pencil end, and the button is pushed on the retractable track to extend the track with oppositely threaded bottom. Brow pencil is threaded on and the button is pushed back down to retract. The same is done for the eye liner pencil and "Push Pop Lip gloss/Lip stick". The cap is replaced to keep the product clean. On the other end, the Mascara is just threaded into the pen. The first part of the cosmetic device—the "finishing" part is ready. The two pens are then attached together, where the magnets keep them connected as one. Then simply place in bag, purse, suitcase or drawer.

To use the cosmetic device, first you would use the "color" part. On one end is the "Roll On Foundation". There is a cap (to keep the product clean) which is removed. The foundation is rolled onto the face, and the cap returned. On the other end, the flip door is opened to access color pallets. The "Concealer", which is applied by the double sided concealer brush conveniently attached to the flip door is applied. The "Blush" which is applied by the blush brush which is the other end of the double sided brush is applied. The three eye shadow colors which is applied by the double sided eye shadow/angle brush conveniently attached to the flip door is applied. All color pallets can be applied while looking into the mirror attached to the outside of the pen.

Second, you would use the "finishing" part. There is a cap (to keep product clean) which is removed. Inside the cap is a "sharpener" for sharpening the brow and eye liner pencils as needed. The push button is pushed on the retractable track to extend the eye brow pencil. The pencil is used on the face, and then retracted by the push button. Then the second push button is pushed on the retractable tract to extend the eyeliner pencil. It is used on the face, and then retracted by the push button. Then the third push button on the retractable track is pushed up for the "Push Pop" Lip Gloss//Lip Stick which is applied to the lips, and the push button is retracted. The cap is replaced to keep products clean. On the other end, there is Mascara, after it is used the two housings attach together and become one, so they may conveniently be put away in a drawer or in a purse or suitcase.

To use this invention one would just insert the colors of make up needed for the day, night, or season into the two pens, push them together so they magnet to become one, and simply put it in your purse, suitcase, back pack or travel bag and go. Therefore eliminating forgetting any items needed for your daily face routine, and eliminating fishing through your purse, back pack or suit case and eliminating clutter.

What I claim as my invention is:

1. A cosmetic storage and application device comprising:

a first housing having a front end, a rear end, and an exterior wall extending between the front and the rear end;

wherein the first housing comprises:

a plurality of tracks extending partially through the exterior wall;

a plurality of cosmetics, wherein each cosmetic is attached to one of the plurality of tracks;

a chamber having an opening extending through the front end of the first housing;

a detachable reservoir extending from the chamber through the opening of the front end;

a detachable cap comprising a cosmetic applicator;

wherein the plurality of cosmetics may each independently extend or retract through the rear end of the first housing.

2. The cosmetic storage and application device of claim 1, wherein each of the plurality of cosmetics comprises an attachment mechanism, and each of the plurality of tracks comprises an opposite attachment mechanism to secure each of the plurality of cosmetics to each of the plurality of tracks.

3. The cosmetic storage and application device of claim 1, wherein each of the plurality of tracks is associated with a push-button to independently extend or retract each of the plurality of cosmetics through the rear end of the first housing.

4. The cosmetic storage and application device of claim 1, wherein the first housing further comprises a second cap that detachably covers the rear end of the housing.

5. The cosmetic storage and application device of claim 4, wherein the second cap comprises a sharpener.

6. The cosmetic storage and application device of claim 1, wherein the detachable reservoir contains mascara and the plurality of cosmetics comprises: (1) an eyebrow pencil, (2) an eye liner pencil, and (3) a lip gloss or lip stick.

7. The cosmetic storage and application device of claim 1, wherein the device further comprises a second housing having a front end, a rear end, and an exterior wall extending between the front and the rear end, wherein the first and second housings each comprise attachment means, wherein the attachment means detachably connects the first and second housings along the respective exterior walls in a side-by-side configuration.

8. The cosmetic storage and application device of claim 7, wherein the attachment means comprise magnets.

9. The cosmetic storage and application device of claim 7, wherein the second housing comprises:

a compartment, wherein the compartment comprises a second plurality of cosmetics;

a first door having an open and closed position, wherein when the door is in the closed position, the door forms a portion of the exterior wall of the second housing and when the door is in the open position, the compartment comprising the second plurality of cosmetics is exposed;

a first chamber interior to the exterior wall of the second housing, with an opening extending through the front end of the second housing, wherein first chamber contains a third cosmetic and the opening houses a detachable cosmetic applicator;

a second chamber interior to the exterior wall of the second housing, with an opening extending through the rear end of the second housing, wherein the second chamber contains a fourth cosmetic.

10. The cosmetic storage and application device of claim 9, wherein the second plurality of cosmetics comprise eye shadow, blush, and concealer, the third cosmetic is a cosmetic foundation, and the fourth cosmetic is lip gloss.

11. A cosmetic storage and application device comprising:

a first housing having a front end, a rear end, and an exterior wall extending between the front and the rear end;

wherein the first housing comprises:

a compartment, wherein the compartment comprises a plurality of cosmetics;

a first door having an open and closed position, wherein when the door is in the closed position, the door forms a portion of the exterior wall of the first housing and when the door is in the open position, the compartment comprising the plurality of cosmetics is exposed;

at least one detachable cosmetic applicator secured to an interior wall of the door;

a mirror;

a first chamber interior to the exterior wall, with an opening extending through the front end, wherein first chamber contains a second cosmetic and the opening houses a second detachable cosmetic applicator;

a second chamber interior to the exterior wall, with an opening extending through the rear end, wherein the second chamber contains a third cosmetic;

a movable cover for the rear end of the first housing.

12. The cosmetic storage and application device of claim 11, wherein the second detachable cosmetic applicator is a roll-on applicator, the first housing further comprising a cap that detachably covers the front end of the housing and the second detachable cosmetic applicator.

13. The cosmetic storage and application device of claim 11, wherein the at least one detachable cosmetic applicator comprises at least one dual-sided brush.

14. The cosmetic storage and application device of claim 11, wherein the mirror is attached to the exterior wall of the first housing.

15. The cosmetic storage and application device of claim 11, wherein the plurality of cosmetics are stored in pallets, whereby the pallets are detachably secured to a wall of the compartment.

16. The cosmetic storage and application device of claim 11, wherein the plurality of cosmetics comprises eye shadow, blush, and concealer, the second cosmetic is a cosmetic foundation, and the third cosmetic is lip gloss.

17. The cosmetic storage and application device of claim 11, wherein the device further comprises a second housing having a front end, a rear end, and an exterior wall extending between the front and the rear end, wherein the first and second housings each comprise attachment means, wherein the attachment means detachably connects the first and second housings along the respective exterior walls in a side-by-side configuration.

18. The cosmetic storage and application device of claim 17, wherein the second housing comprises:

a plurality of tracks extending partially through the exterior wall;

a second plurality of cosmetics each attached to one of the plurality of tracks;

wherein the plurality of cosmetics may each independently extend or retract through the rear end of the second housing.

19. A cosmetic storage and application device comprising:

a first housing having a front end, a rear end, and an exterior wall extending between the front and the rear end;

wherein the first housing comprises:

a plurality of tracks extending partially through the exterior wall;

a plurality of cosmetics each attached to one of the plurality of tracks;

wherein the plurality of cosmetics may each independently extend or retract through the rear end of the first housing;

wherein each of the plurality of tracks comprises a push-button to independently extend or retract each of the plurality of cosmetics through the rear end of the first housing;

wherein each of the plurality of cosmetics comprises an attachment mechanism, and each of the plurality of tracks comprises an opposite attachment mechanism to secure each of the plurality of cosmetics to each of the plurality of tracks, wherein the attachment mechanism comprises male threads and the opposite attachment mechanism comprises female threads, or the attachment mechanism comprises female threads and the opposite attachment mechanism comprises male threads;

wherein the first housing further comprises a cap having a sharpener that detachably covers the rear end of the housing;

wherein the first housing further comprises a chamber interior to the exterior wall, with an opening extending through the front end, wherein the first housing further comprises:

a detachable reservoir extending from the chamber through the opening of the front end;

a detachable cap comprising a cosmetic applicator;

a second housing having a front end, a rear end, and an exterior wall extending between the front and the rear end, wherein the first and second housings each comprise attachment means, wherein the attachment means detachably connects the first and second housings along the respective exterior walls in a side-by-side configuration;

wherein the second housing comprises:

a compartment, wherein the compartment comprises a second plurality of cosmetics;

a first door having an open and closed position, wherein when the door is in the closed position, the door forms a portion of the exterior wall of the first housing and when the door is in the open position, the compartment comprising the plurality of cosmetics is exposed;

at least one detachable cosmetic applicator secured to an interior wall of the door;

a mirror, wherein the mirror is attached to or embedded in a flat portion of the exterior wall;

a first chamber interior to the exterior wall, with an opening extending through the front end, wherein first chamber contains a second cosmetic and the opening houses a second detachable cosmetic applicator;

a second chamber interior to the exterior wall, with an opening extending through the rear end, wherein the second chamber contains a third cosmetic;

a movable cover for the rear end of the first housing.

* * * * *